United States Patent [19]

Uchino

[11] Patent Number: 4,709,787

[45] Date of Patent: Dec. 1, 1987

[54] ELEVATOR

[76] Inventor: Eiji Uchino, 4-12, Kamo 2-chome, Takaishi-shi, Osaka-pref., Japan

[21] Appl. No.: 882,954

[22] Filed: Jul. 14, 1986

[30] Foreign Application Priority Data

Dec. 11, 1985 [JP] Japan ..... 60-191187

[51] Int. Cl.[4] ..... B66B 13/00

[52] U.S. Cl. ..... 187/56; 187/1 R

[58] Field of Search ..... 187/98, 1 R, 32, 40, 187/56, 51; 49/483, 488

[56] References Cited

U.S. PATENT DOCUMENTS 687,537 11/1901 Metzger ..... 187/98
1,406,951 2/1922 Fehr ..... 187/1 R
3,920,101 11/1975 Richards ..... 187/1 R

FOREIGN PATENT DOCUMENTS 690910 7/1964 Canada ..... 187/98
1107341 12/1955 France ..... 187/1 R
1397377 3/1965 France ..... 187/98

*Primary Examiner*—Joseph J. Rolla
*Assistant Examiner*—Nils Pedersen
*Attorney, Agent, or Firm*—Harold Gell

[57] ABSTRACT

This invention concerns an elevator provided with an elastic member. The elastic member, by and large triangular in cross section, is attached to every exit of an elevator: an end of each floor inside a vertical path in which a cage ascends and descends or a floor end of a cage so as to stuff a gap at every exit. Therefore, even if passengers carelessly drop their small article, it is prevented from escaping from the gap. Other than that, women's high heels and children's shoes are prevented from getting into it; likewise, the wheels of loaded trucks do not get into it. The elastic member, designed to be a shock absorber, gives a cage no substantial shock even when the cage strikes against it a little.

7 Claims, 4 Drawing Figures

ELEVATOR

This invention relates to an elevator that carries passengers or loads to a desired floor of a building by means of a cage which ascends or descends freely in a vertical path. More particularly, this invention relations to an elastic member to be attached to an elevator for the purpose of preventing inadvertently dropped things from escaping through a gap between the front end of the floor of a cage and an end of every floor of a building opposed thereto.

Conventionally, there is intentionally provided a little gap between the front end of the floor of a cage and the opposed end of each floor of a building in order that tremors caused by earthquakes or big motor cars passing by the building. On account of the presence of such gap, passengers getting in or out a cage tend to lose their small articles when they carelessly dropped them into it because picking them up usually requires a lot of time and trouble; besides it is unsuccessful in most cases.

Accordingly, it is an object of this invention to provide an elevator with such an elastic member whose upper surface lies so flush with and so near the floor of a cage and the floor of each floor of a building that not only does the elastic member prevent carelessly dropped small articles from escaping through the gap but prevents women's high heels and children's shoes from getting into it whereby the passengers' safety is assured and loaded trucks are also able to be embarked or disembarked without any fear of their wheels getting into it. It is another object of this invention to provide an elevator with such an elastic member, made of rubber or the like, that does not give a cage any shock by its deformable, shock-absorbing elasticity even when the cage strikes against it and can also be incorporated in any conventional elevator without hindering the ascending and descending movement of a cage.

The above and other objects and features of the invention will appear more fully hereinafter from a consideration of the following description taken in connection with the accompanying drawings wherein one example is illustrated by way of example.

Figure 2:
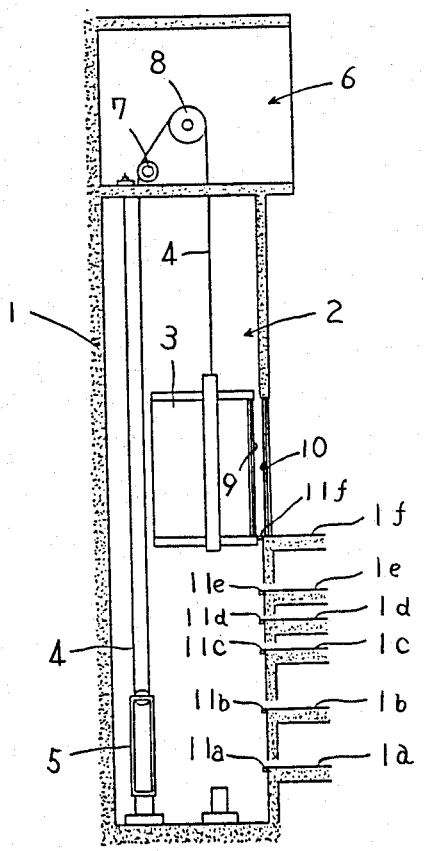
FIG. 2 is a side view of an entire elevator equipment.

Now this invention will be described in detail with reference to the accompanying drawings. In FIG. 2, a box-shaped cage 3 which can hold passengers or loads is suspended by a wire cable 4 in a vertical path 2 communicating with an exit of every floor 1*a*–1*f* of a building 1. One end of the cable 4 is fastened to the upper part of the vertical path, while the other is fastened to the top of the cage 3 by way of a wheel attached to a counterweight 5, a guide wheel 7 and a hoist 8, where the guide wheel and the hoist are located in a motor room 6. When a motor of the hoist 8 gets started, the cable is veered down or hauled up in order to lower or lift the cage in accordance therewith by means of the counterweight 5. In this way, passengers or loads can be carried to any desired floor. When the floor 3*a* of the cage 3 gets flush with any desired floor, a pair of right and left sliding doors 9, 9 of the cage 3 and a pair of right and left sliding doors 10, 10 of that floor open at the same time so as to give there an exit, whereby passengers or loaded trucks are permitted to get in or get out.

Figure 3:
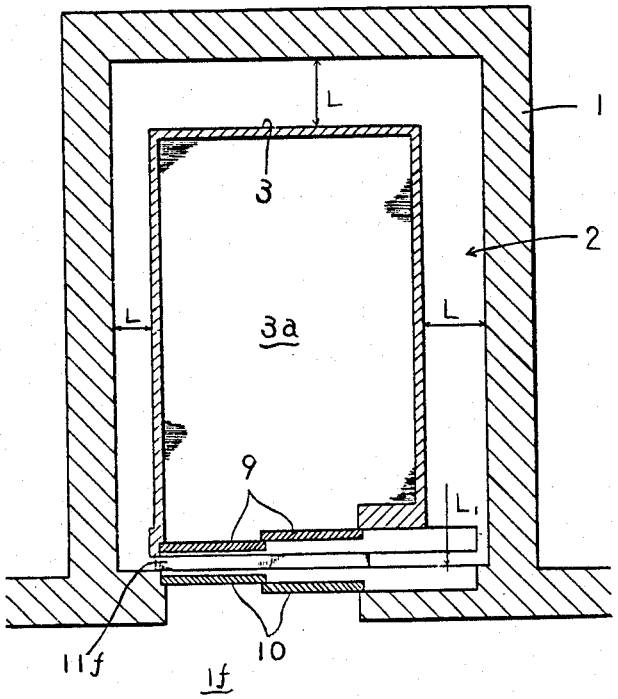
FIG. 3 is a cross-sectional plan view of a cage and a vertical path through which the same cage moves up and down.

Referring now to the spatial relation between the cage 3 and the vertical path 2 with reference to FIG. 3, there is provided a considerably wide gaps $L_1$, L around the cage. An elastic member (hereinafter referred to as a rubber step 11*a*–11*f*) whose length is nearly the same as the width of the exit, whose width is nearly the same as the gap $L_1$ and whose cross-section is triangular in shape, is attached to the end of each floor inside the vertical path 2 so as to be flush with each other. Hence, the tip of the triangular rubber steps 11*a*–11*f* gently touches to the front floor end of the cage 3. In other words, only when the cage 3 stops at a desired floor, a rubber step at that floor is put between the cage 3 and that floor end as if it is stuffed into the gap $L_1$ and there forms a continuous plane uniting the floor of the cage and that floor.

Figure 1:
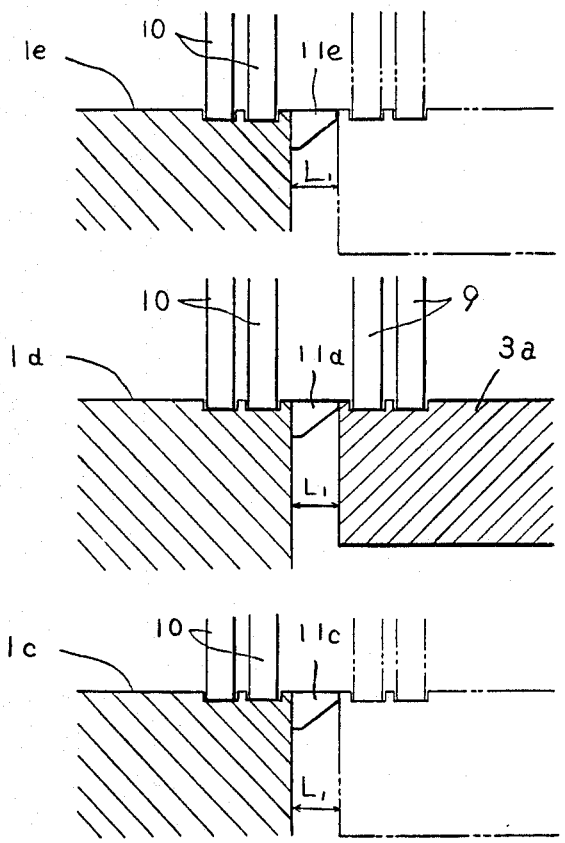
FIG. 1 is a partially enlarged side view of an essential part of an elastic member of this invention.
Figure 4:
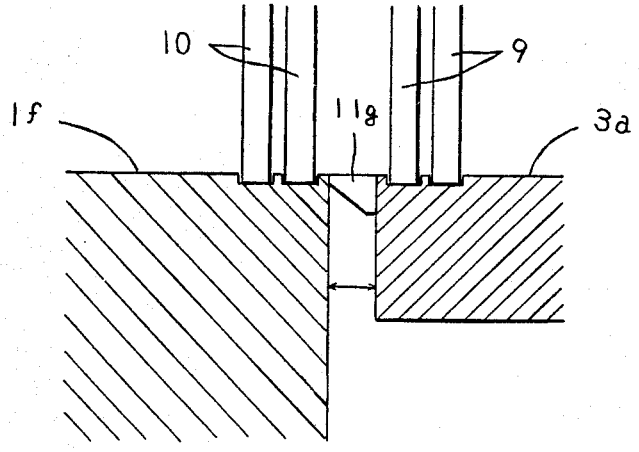
FIG. 4 is a partially enlarged side view of an essential part of another example of this invention.

As shown in FIG. 4, a rubber step 11*g* can of course be attached to the front floor end of the cage in place of every floor end inside the vertical path 2; the same effect can be brought out like this.

As best seen from the above, according to this invention a rubber step 11*a*–11*g*, or 11*g* is put in the gap $L_1$ between the cage 3 and every floor where the cage stops at so as to prevent inadvertently dropped small articles from escaping therefrom. Other than that, a newly formed continuous plane uniting the floor of the cage and the floor of the building serves to prevent women's high heels and children's shoes from getting into the gap. The passengers' safety is thus protected; at the same time, loaded trucks are able to be embarked or disembarked without any fear of their wheels getting into the gap. The rubber steps 11*a*–11*f*, or 11*g* are thus very helpful for not only passengers but loads; on the other hand, they never give the cage 3 substantially any shock even if the cage should strike against them stopping at wrong position because their elasticity absorbs it; moreover, they are never an obstacle to the cage incessantly ascending and descending in the vertical path and their attachment is quite simple as well as their structure.

While preferred embodiments of this invention have been illustrated and described, variations and modification may be apparent to those skilled in the art. Therefore, I do not wish to be limited thereto and ask that the scope and breadth of this invention be determined from the claims which follow rather than the above description.

What I claim is:

1. An elevator including a cage having a floor, said cage positioned within a vertical shaft inside a building having floors, comprising:

an elastic member comprising an elongated body with a right triangle cross-section placed between the front edge of said elevator cage floor and the building floor edge abutting said front edge of said elevator cage floor with one side lying in the plane of said elevator cage floor and the hypotenuse facing the bottom of said shaft and both the elevator cage and the building floor having sliding doors for permitting entry and exit to and from the cage only when the cage floor is level with the building floor.

2. An apparatus as defined in claim 1 wherein at least one acute angle forming the right triangular cross-section of said elastic member is truncated.

3. An elevator, comprising:

an elastic member comprising an elongated body with a right triangle cross-section attached by one side to the front edge of the floor of an elevator cage, said elastic member positioned and dimensioned so the second side of said right triangle is in the plane of said elevator cage floor to fill the gap between said elevator cage floor and the edge of a building floor adjacent to said elevator floor and both the elevator cage and the building floor having sliding doors for permitting entry and exit to and from the cage only when the cage floor is level with the building floor.

4. An apparatus as defined in claim 3 wherein at least one acute angle forming the right triangular cross-section of said elastic member is truncated.

5. In an elevator system including a shaft passing vertically through a plurality of floors of a building and including a cage adapted for vertical movement between said floors, the improvement comprising:

an elastic seal comprising an elongated body with a right triangle cross-section positioned at the edge of each floor abutting said elevator shaft opening, said elastic seals attached along one side at the edge of each floor and positioned and dimensioned so the second side of said right triangle is in the plane of the adjacent floor to fill the gap between the elevator cage floor and the building floor when the elevator cage is parked at said respective floor and both the elevator cage and the building floor having sliding doors for permitting entry and exit to and from the cage only when the cage floor is level with the building floor.

6. An apparatus as defined in claim 5 wherein said elastic seal provides a step surface flush with said building floor and said elevator cage floor when said elevator is stopped adjacent to said building floor.

7. An apparatus as defined in claim 5 wherein at least one acute angle forming the right triangular cross-section of said elastic seal is truncated.

* * * * *